US009175873B2

(12) United States Patent
Sheldon et al.

(10) Patent No.: US 9,175,873 B2
(45) Date of Patent: Nov. 3, 2015

(54) DIVERSION DAMPER

(75) Inventors: Gregory S. Sheldon, Woodland, CA (US); David A. Springer, Winters, CA (US); Joshua B. McNeil, Woodland, CA (US)

(73) Assignee: NIGHTBREEZE CORP., Davis, CA (US)

( * ) Notice: Subject to any disclaimer, the term of this patent is extended or adjusted under 35 U.S.C. 154(b) by 1246 days.

(21) Appl. No.: 13/081,019

(22) Filed: Apr. 6, 2011

(65) Prior Publication Data

US 2011/0247694 A1 Oct. 13, 2011

Related U.S. Application Data

(60) Provisional application No. 61/282,851, filed on Apr. 9, 2010.

(51) Int. Cl.

| | |
|---|---|
| ***F24F 13/10*** | (2006.01) |
| ***F24F 13/02*** | (2006.01) |
| *F24F 13/14* | (2006.01) |

(52) U.S. Cl.

CPC ..... *F24F 13/0236* (2013.01); *F24F 13/1413* (2013.01); *F24F 13/1426* (2013.01); *F24F 2013/1473* (2013.01); *Y10T 137/0318* (2015.04); *Y10T 137/8593* (2015.04)

(58) Field of Classification Search

CPC ..... F24F 13/1413; F24F 2013/1473; F24F 13/1426

USPC ..... 454/237, 343, 358, 239, 333; 137/106, 137/111, 625.18, 625.24, 625.43, 601.15

See application file for complete search history.

(56) References Cited

U.S. PATENT DOCUMENTS

| | | | | |
|---|---|---|---|---|
| 2,436,728 | A * | 2/1948 | Parsons | 296/146.16 |
| 4,218,608 | A * | 8/1980 | Maroney | 392/385 |
| 4,267,880 | A * | 5/1981 | Jacquet | 165/41 |
| 4,498,528 | A * | 2/1985 | Jacquet | 165/42 |
| 5,024,263 | A * | 6/1991 | Laine et al. | 165/283 |
| 5,044,402 | A * | 9/1991 | Haas | 137/875 |
| 5,065,585 | A | 11/1991 | Wylie et al. | |
| 5,199,461 | A * | 4/1993 | Carr | 137/625.44 |
| 6,817,378 | B2 * | 11/2004 | Zelczer | 137/601.09 |
| 7,398,821 | B2 * | 7/2008 | Rainer et al. | 165/247 |
| 8,915,194 | B2 * | 12/2014 | Creighton | B61D 7/24 105/286 |
| 2005/0113015 | A1 * | 5/2005 | Crippen et al. | 454/184 |
| 2009/0029642 | A1 * | 1/2009 | Martel et al. | 454/358 |

* cited by examiner

*Primary Examiner* — Gregory Huson
*Assistant Examiner* — Frances F Hamilton
(74) *Attorney, Agent, or Firm* — Oliff PLC

(57) ABSTRACT

A diversion damper is provided for managing air flow in an air handling system. The diversion damper has a first movable air deflector and a separate second movable air deflector, each of which are movable between a first position and a second position. A linkage assembly is provided connecting the first movable air deflector and the second movable air deflector. The linkage assembly has a single actuator and is further configured to cooperatively move the first movable air deflector and the second movable air deflector between the respective first position and the second position for each of the first movable air deflector and the second movable air deflector, and to apply a sealing pressure to establish a substantially airtight seal around the each of the first movable air deflector and the second movable air deflector in the first position, around the first air flow deflector in the second position.

20 Claims, 8 Drawing Sheets

DIVERSION DAMPER

This disclosure is directed to a device for managing air flow in an air handling system. This device may be used to divert air in a heating or cooling assembly.

BACKGROUND

Buildings can be cooled and heated by selectively recirculating air within the building using a conventional air handling system, or admitting outside air into the building via the air handling system, while removing excess air via an exhaust capacity in the air handling system depending on the difference between outside ambient conditions and a desire to cool, heat, or ventilate the interior space of the building. In air handling systems, fans are typically used to recirculate air throughout the building for heating or cooling. Typical circulation fans in air handling systems are often operated in conjunction with damper devices mounted to or within the air handling systems to divert a source of air from indoors to outdoors.

U.S. Pat. No. 5,065,585 to Wylie ("the 585 patent") discloses an apparatus for cooling the interior of a building. The apparatus disclosed in the 585 patent includes a movable blade-type damper assembly mounted in a damper housing. A shaft extends between end walls of the damper housing in the 585 patent and supports the movable blade. A motor drives the shaft to adjust the position of the movable blade between two positions. FIG. 2A of the 585 patent illustrates a first position where air flow communication is established in the damper housing between an outside inlet air duct and interior air outlet duct. At the same time, air is directed from an interior return air duct to an outside outlet air duct to relieve a buildup of air pressure inside the building in which the disclosed air handling system is installed. FIG. 2B of the 585 patent illustrates a second position of the movable blade where air flow communication is established in the damper housing between the interior return air duct and the interior air outlet duct. This position allows for recirculation of air flow within the interior of the building.

The apparatus disclosed in the 585 patent suffers certain shortfalls in operation. Generally, the motor that drives the shaft, based on its actual location at the center of the system, is incapable of exerting enough force/pressure to the blade. Based on this lack of pressure, the blade, while it diverts air, is virtually incapable of sealing the flow path made by the blade in either direction. This, therefore, makes the apparatus disclosed in the 585 patent susceptible to leakage based on, among other things, multiple leak paths and inadequate sealing. The movable blade pivoting at its center makes it difficult to seal around the hinge points and along the sides of the blade. There are also height constraints imposed by the single-blade configuration disclosed in the 585 patent that do not allow for installation of the apparatus in certain size restricted areas. Many attics, for example, cannot accommodate the height requirement of such an apparatus for the enclosure and outside air duct that connects to the top of the apparatus. Finally, the apparatus disclosed in the 585 patent is not able to connect to more than one return air duct. Exterior provisions can be made but size, cost and complexity increase.

SUMMARY

Damper devices that are used to divert the source of air from indoor to outdoors may be consolidated in a single four-way damper assembly. Such a four-way damper assembly may reduce cost, conserve space, facilitate filtration of both indoor and outdoor air, and improve accessibility to the system for maintenance. A four-way damper should seal tightly to minimize loss of heated or cooled air through the damper. Loss of heated or cooled air, as discussed above, compromises the efficiency of the heating or cooling system. In view of the above shortfalls in prior art systems, such as those disclosed in the 585 patent, a need for a more compact, efficient and versatile system exists. Simplicity in construction, installation and operation, and an ability to more positively seal respective air flow paths and reduce air friction, are objectives of such an improved device.

This disclosure describes systems and methods that may address the shortfalls in prior art systems discussed above by providing systems and methods to effect complete sealing in switchable air flow paths, a more compact structure to the air handling device, and an additional capacity to accommodate a second and separate return air flow path via the air handling device in air flow communication with an air handling system.

Advantages that may be associated with the systems and methods according to this disclosure include more effective sealing in a first position that provides recirculating air flow from an enclosed space through the air handling system, and a second position that makes provision for admitting fresh outside air to, and exhausting over pressure indoor air from, the air handling system through the preferable use of a pair of air deflectors by further selectively mounting the pair of air deflectors in a manner such that they each pivot from one edge. This configuration allows each air deflector to make positive pressurized contact against a foam seal for each of the deflectors in one, or both, of the first and second positions of the device. By changing from a horizontally to a vertically pivoting air deflector, the system and methods according to this disclosure may provide a more compact overall profile, particularly in the vertical. The system and methods may also provide accommodation for placing a second return air flow path in air flow communication with the air handling system.

Exemplary systems and methods according to this disclosure may include an air deflecting apparatus for managing air flow in an air handling system having a first movable air deflector that is movable between a first position and a second position, a second movable air deflector that is a separate air deflector from the first movable air deflector and that is movable between a first position and a second position, and a linkage assembly connecting the first movable air deflector and the second movable air deflector. The linkage assembly may include a single actuator, and be specifically configured to cooperatively move the first movable air deflector and the second movable air deflector between the respective first position and second position for each of the first movable air deflector and the second movable air deflector. Further, the linkage assembly may be configured to ensure a sealing pressure to each of the first movable air deflector and the second movable air deflector to establish a substantially airtight seal around the each of the first movable air deflector and the second movable air deflector in the first position. The linkage assembly may also be configured to at least establish a substantially airtight seal around the first movable air deflector when moved to the second position for the first movable air deflector in which, the first air deflector specifically segregates separate air flow paths within the device for admitting air to or exhausting air from the device.

Further, the exemplary systems and methods according to this disclosure may provide a system for managing air flow in an air handling system having a means for moving a first movable air deflector between a first position and a second position, a means for moving a second movable air deflector that is a separate air deflector from the first movable air deflector between a first position and a second position, and a means for adjusting the first movable air deflector and the second movable air deflector. The adjusting means may be configured to cooperatively move the first movable air deflector and the second movable air deflector between the respective first position and the second position for each of the first movable air deflector and the second movable air deflector, to apply sealing pressure to each of the first movable air deflector and the second movable air deflector to establish a substantially airtight seal around the each of the first movable air deflector in at least one of the first and second positions for each of the movable air deflectors.

Finally, the exemplary systems and methods according to this disclosure may provide a method for managing air flow in an air handling system having a step of moving a first movable air deflector between a first position and a second position, and cooperatively moving a second movable air deflector that is a separate air deflector from the first movable air deflector between a first position and a second position, by adjusting the first movable air deflector and the second movable air deflector with a linkage assembly. The linkage assembly may be specifically configured for cooperatively moving the first movable air deflector and the second movable air deflector between the respective first position and the second position for each of the first movable air deflector and the second movable air deflector, and further configured far applying a sealing pressure to each of the first movable air deflector and the second movable air deflector to establish a substantially airtight seal around the each of the first movable air deflector and the second movable air deflector in either of the respective first position and the second position for the first movable air deflector and in the first position for the second movable air deflector.

These and other features and advantages of the disclosed apparatus are described in, or apparent from, the following detailed description of the various exemplary embodiments.

BRIEF DESCRIPTION OF THE DRAWINGS

Various exemplary embodiments of the disclosed device for managing air flow in an air handling system will be described, in detail, with reference to the following drawings wherein.

DETAILED DESCRIPTION OF EMBODIMENTS

The following exemplary embodiments may refer to apparatuses for heating, cooling, and ventilating an enclosed space and air deflectors to be used in such apparatuses. It should be appreciated that, although the exemplary systems and methods according to this disclosure may be applicable to specific applications, the depictions and/or descriptions included in this disclosure are not intended to be limited to any specific application. Any apparatus for heating, cooling, or ventilating an enclosed space that may advantageously include a device for managing air flow in an air handling system as described in an exemplary manner in this disclosure is contemplated.

Figure 1:
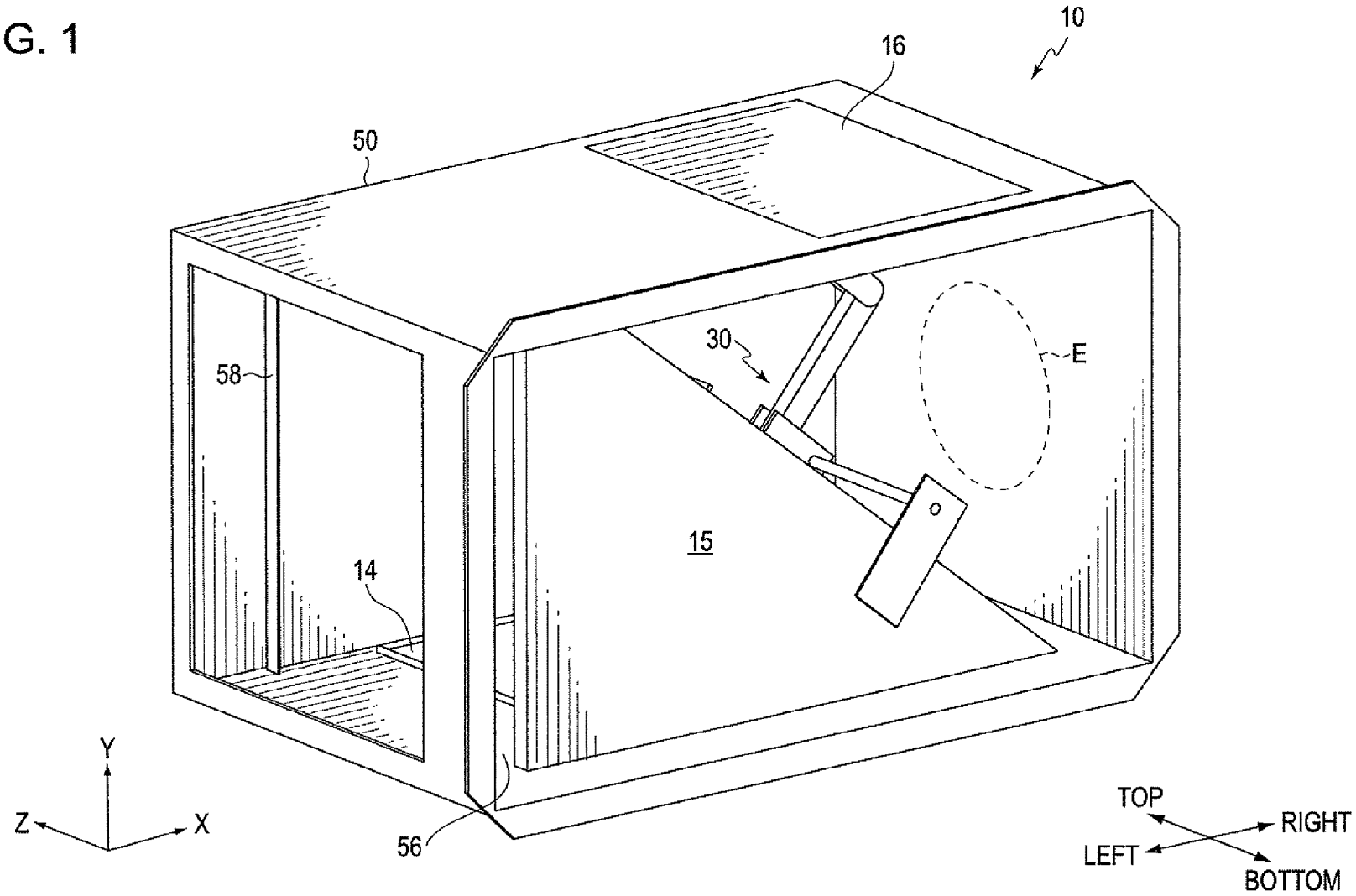
FIG. 1 illustrates a first exemplary perspective view of a device for managing air flow in an air handling system showing a linkage assembly in an extended (first) position.

FIG. 1 illustrates an exemplary air handling device 10 for managing air flow in an air handling system. The air handling device 10, for example, may include an insulated outer cabinet 50, as shown. Otherwise, the air handling device 10 may not include a specific cabinet 50, as shown, but rather may be incorporated into a portion of the duct work associated with the air handling system. Regardless of the installation, the device, as described further below, may include substantially all of the individual component pieces associated with the systems and methods according to this disclosure. For example, a linkage assembly 30 may be supported within the air handling system.

When present, the outer cabinet 50 may include a rectangular portion 56 and corresponding side rails 58 as, for example, guides for a filter 100 that filters air exiting the outer cabinet 50.

As will be shown in greater detail below, the linkage assembly 30 may be connected to a first movable air deflector 14 and a second movable air deflector 16. The linkage assembly 30, in an extended or first or recirculating position, (as these terms will be interchangeably used throughout this disclosure) to hold the first movable air deflector 14 and second movable air deflector 16 "closed," or against openings in the outer cabinet 50, or otherwise opening in a duct work in which the exemplary air handling device 10 is placed.

In the specific configuration shown in FIG. 1, it must be noted that the legend, shows that the principal view of the device is from the bottom or air inlet position. In this view, a partition 15 is shown which prevents air from inside the building from entering the air handling system when the damper is in the second position. In this regard, air is admitted to the outer cabinet 50 (recirculated air in this configuration from the enclosed space that the air handling system supports) via the portions of the bottom of the outer cabinet 50 that are not obstructed by partition 15. In later figures, partition 15 will be shown in outline view only in order to clearly illustrate specific details of the air deflectors 14, 16 and the linkage assembly 30 that cannot be adequately illustrated in the obstructed view shown in FIG. 1.

Figure 2:
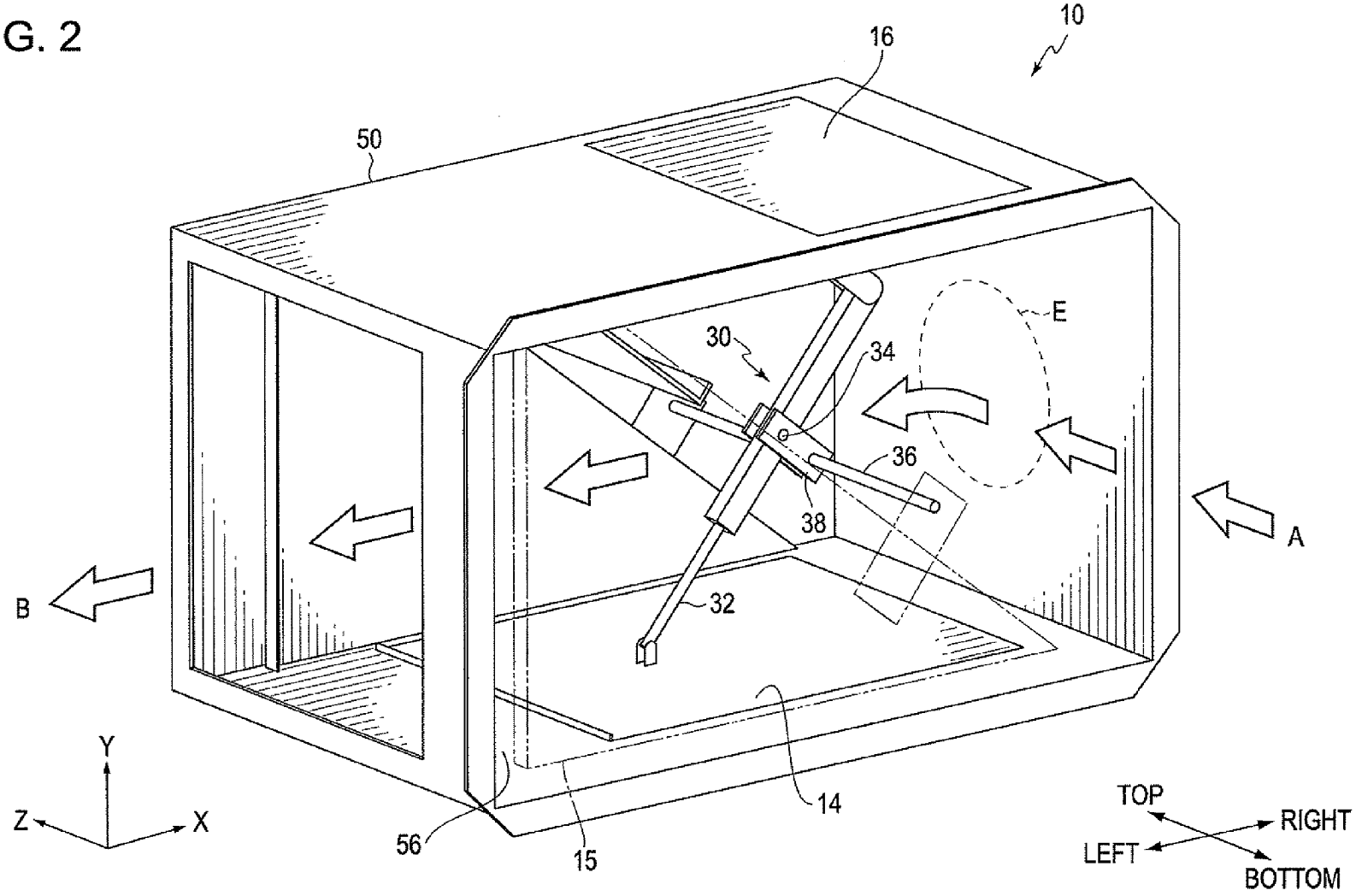
FIG. 2 illustrates a second exemplary perspective view of the device for managing air flow in an air handling system showing the linkage assembly in the extended (first) position.

FIG. 2 illustrates a second exemplary perspective view of the air handling device 10. In FIG. 2, the air handling device 10 is shown in the recirculated air configuration. As indicated above, partition 15 is shown only in an outline view in order to gain better appreciation for the details of the air deflectors 14, 16 and the linkage assembly 30 that provides for cooperative movement of the air deflectors 14, 16 between their "closed" position as shown and their "open" positions as will be shown and described in greater detail below.

The linkage assembly 30 is installed in the outer cabinet 50 via a shaft 36. If installed in traditional duct work, ends of the shaft 36 may be mounted to either side of the duct work to facilitate mounting of the linkage assembly 30. The linkage assembly may also include a linkage bracket 38 that is configured to cooperatively rotate around the shaft 36. An actuator 32 may be connected to the linkage bracket 38 via a pivot point 34. The actuator 32 may, in the extended position (as shown) apply a positive force to the first movable air deflector 14 and a second movable air deflector 16 to seal, in a substantially airtight manner, the first movable air deflector 14 and the second movable air deflector 16 against respective openings in the outer cabinet 50, or otherwise in the duct work in which the air handling device 10 may be installed. This linkage assembly 30 may comprise, for example, only one actuator to create the force that seals between each of the first movable air deflector 14 and a second movable air deflector 16 with the outer cabinet 50. As a result, air flow leakage is minimized by a positive sealing force of air deflectors 14, 16 against cooperative seals in each of the external openings of the outer cabinet 50. It is preferable that the actuator 32 be a linear actuator in order to provide the required pressure to positively seal the external openings of the outer cabinet 50 with air deflectors 14, 16.

In the illustrated extended position of the actuator 32 shown in FIG. 2, the recirculating air flow path is established as shown with the arrows. Recirculating air from the enclosed space enters the bottom of the outer cabinet 50 as shown from air flow position A and flows through the closed outer cabinet 50 via any filter that may be in place at the rectangular portion 56 of the outer cabinet 50. This recirculating air travels toward other components of the air handling system including, for example, but not limited to, a furnace, circulating fans, chillers or other devices and placed to move and/or condition the air in the air handling system in which the air handling device 10 is placed, as air flows out in the direction B from the outer cabinet 50 and toward any such downstream devices. An advantage of a configuration of an air handling device 10 such as that shown in exemplary manner in FIG. 2 is that an optional opening E may be provided to facilitate attachment of separate ducting to establish a return air flow capability from a second completely separate return air flow path into the outer cabinet 50 to be mixed with recirculating air A from the space and exiting the outer cabinet 50 as air flow B through air flow position B. In this extended position, air flow is recirculated by the air flow system within an enclosed space.

Figure 3:
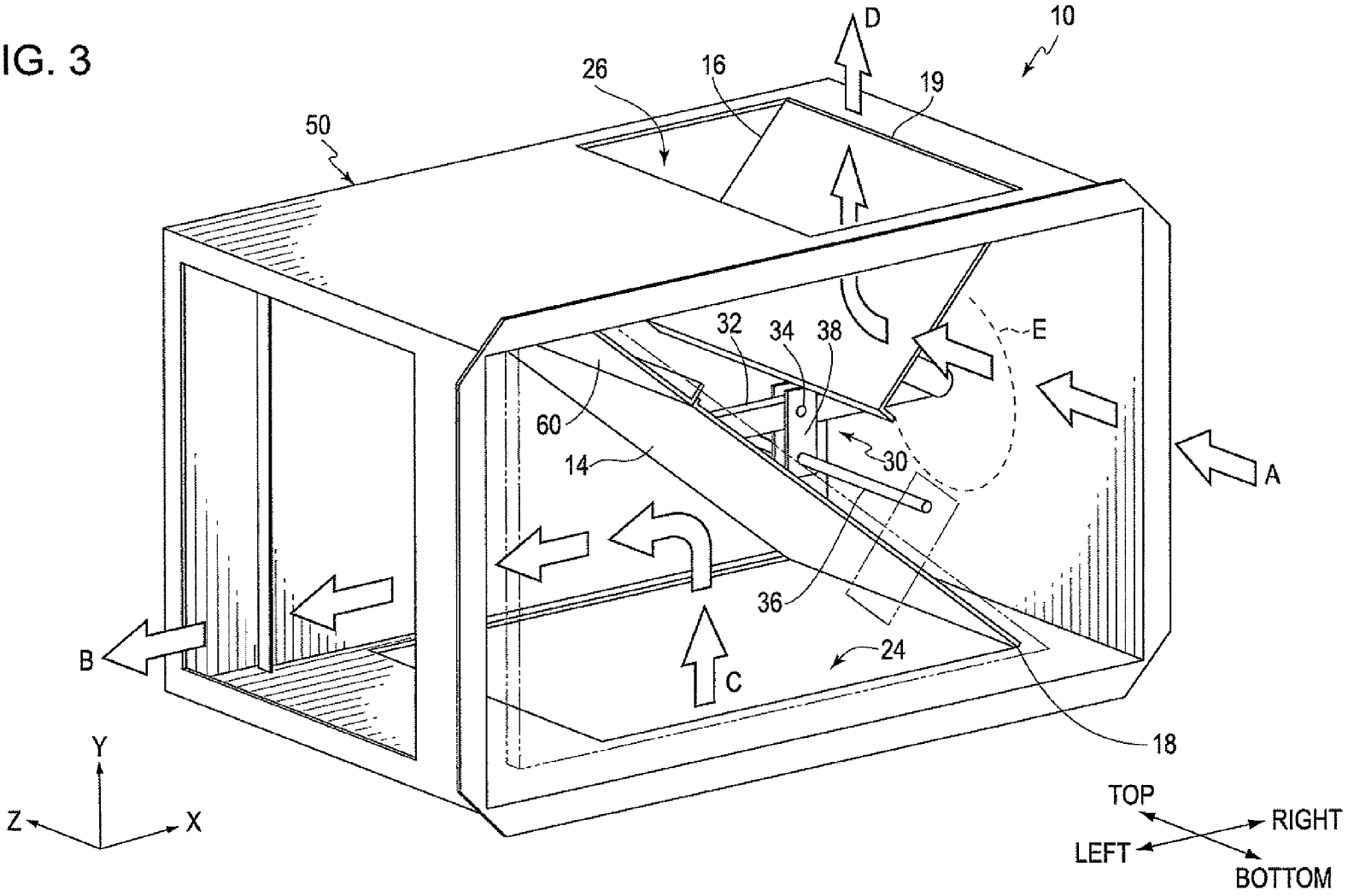
FIG. 3 illustrates a third exemplary perspective view of the device for managing air flow in an air handling system showing the linkage assembly in a retracted (second) position.

FIG. 3 illustrates a third exemplary perspective view of the air handling device 10. FIG. 3 illustrates the linkage assembly 30 in a retracted position. In this position, the actuator 32 in the linkage assembly 30 is adjusted to a retracted position and pivots at the pivot point 34 of the linkage bracket about the shaft 36. As a result, through the operation of the single actuator 32, based on the configuration of the linkage assembly 30, the first movable air deflector 14 and the second movable air deflector 16 simultaneously rotate open about a respective air deflector hinge 18, 19. In this regard, first air deflector 14 is rotated away from one outer wall of the outer cabinet 50 exposing opening 24. Simultaneously, second air deflector 16 is rotated away from an opposite wall in the outer cabinet 50 to expose opening 26. An advantage of the configuration shown, and the action of the actuator in moving air deflectors 14, 16 is that the air deflectors 14, 16 are positively rotated under the force of a single linear actuator 32 inside the outer cabinet 50, or any duct work in which such an air handling device 10 may be mounted. The first movable air deflector 14 is forced to contact and seal against an opening in inner wall 60 to create a sealing surface that segregates two separate air flow paths, for example, an intake air flow path C and an exhaust air flow path D. Intake air flow path C is provided to admit air via opening 24 from outside the air handling system, e.g., outdoor inlet air, to be then circulated downstream in the air handling system as air flow 13, as previously depicted. Admitting outside air flow C via opening 24 in the outer cabinet and forcing that air into the enclosed space will create an over pressure in the enclosed space. Cooperatively, exhaust opening 26 is opened when second air deflector 16 is cooperatively moved inward by action of the single actuator 32 and the linkage assembly 30 to allow air flow A from the enclosed space to be exhausted to outside the air handling system as exhaust air flow D.

Another advantage of this system over prior art systems is that the single actuator 32 forces the first air deflector 14 into substantially sealing contact with an internal opening defined at least by internal wall 60 in order to provide a substantially airtight seal between the inlet air path through the air handling device 10 to the air handling system in which the device is installed and the exhaust air flow path which takes air from the enclosed space at A and exhausts it as exhaust air flow D via opening 26. Additionally, as can be seen from this exemplary depiction, if additional duct work were in place a opening E return air flow from the separately enclosed space entering the outer cabinet would also be forced to exit via exhaust air flow path D.

Figure 4:
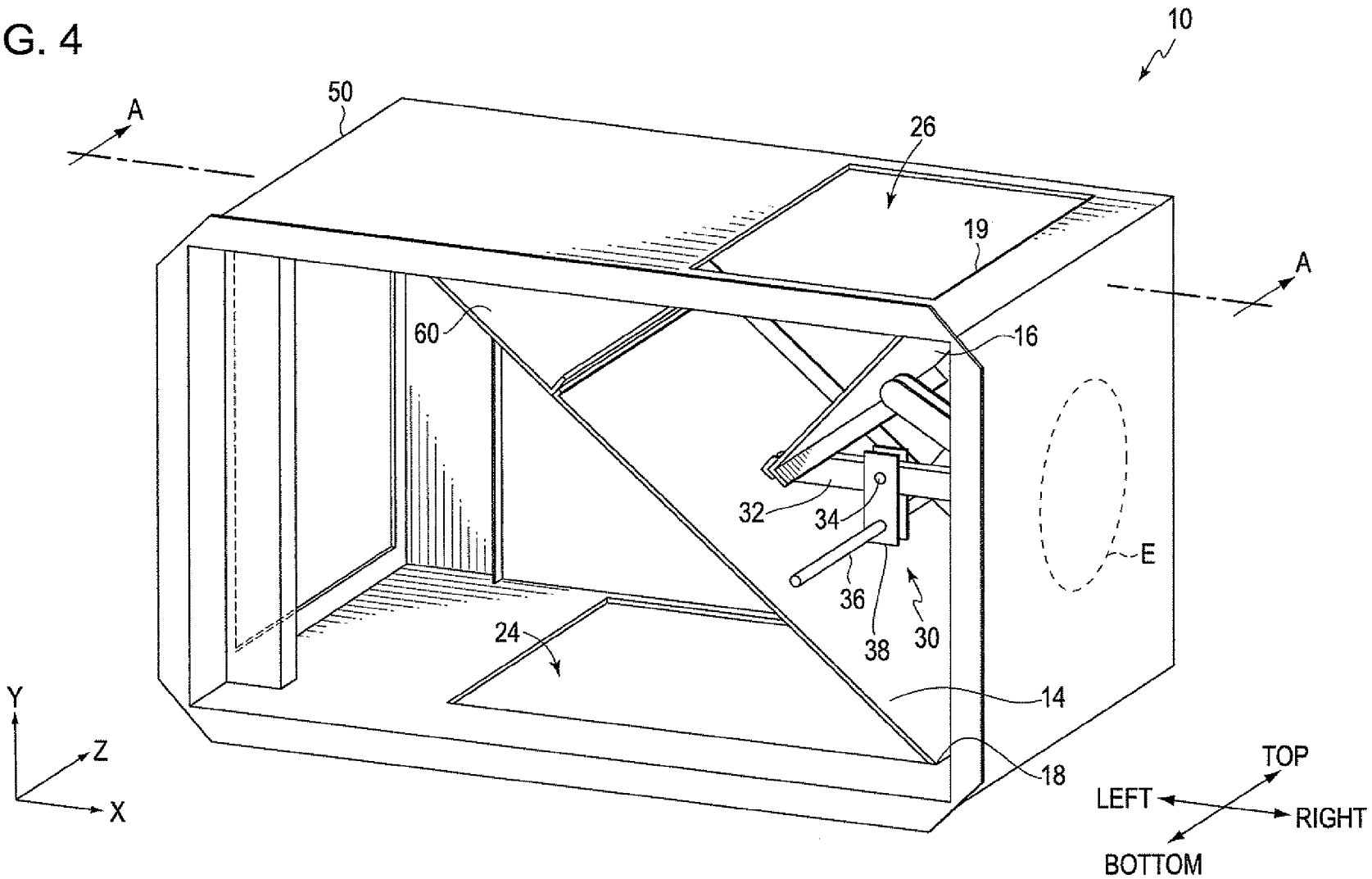
FIG. 4 illustrates a fourth exemplary perspective view of the device for managing air flow in an air handling system when the linkage assembly is in the retracted (second) position.

FIG. 4 illustrates an alternate perspective view of the device 10 for managing air flow in an air handing system 50 in the retracted position for ease of understanding.

Figure 5:
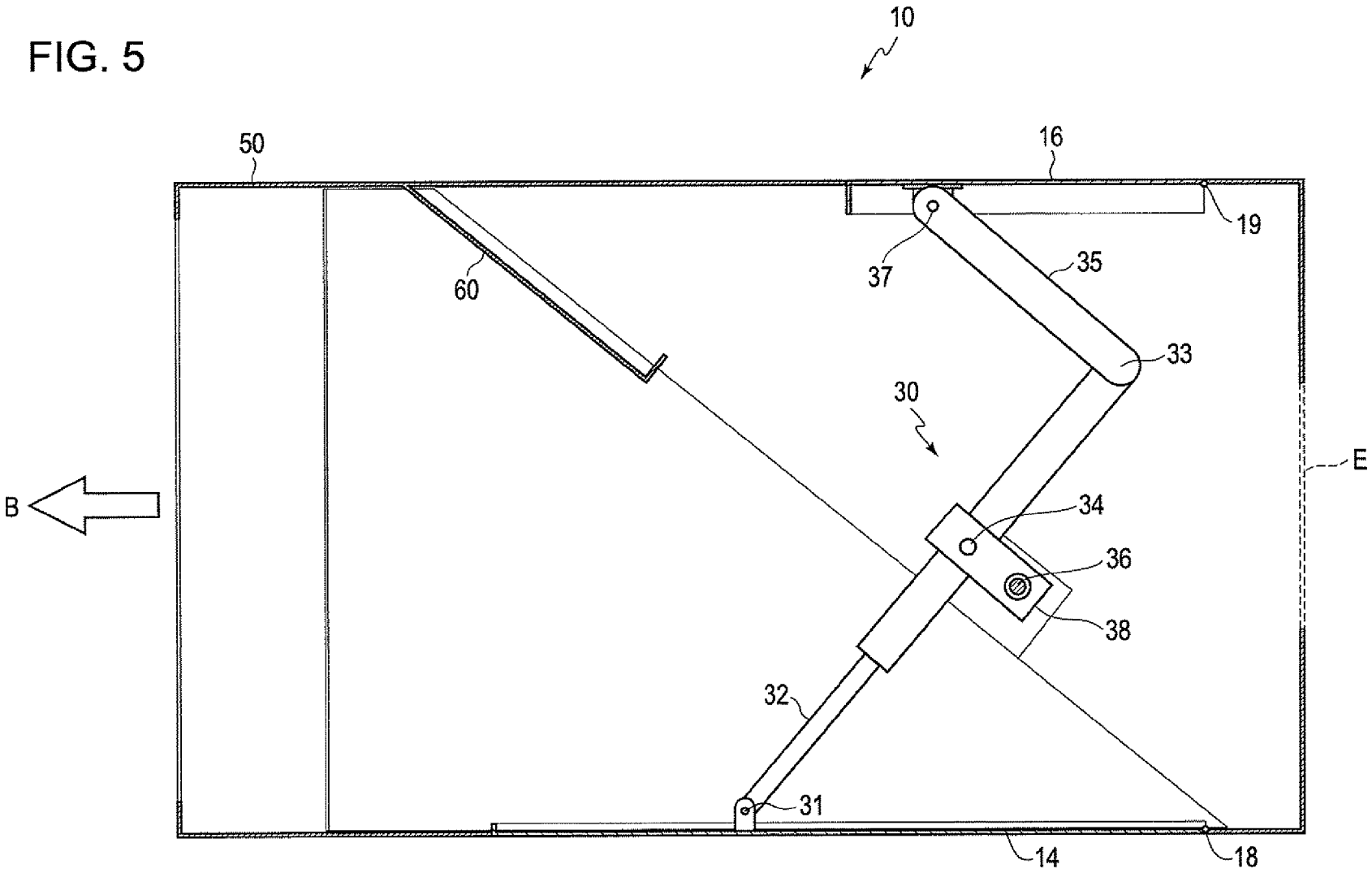
FIG. 5 illustrates a first exemplary cross-sectional view, taken along the line A-A in FIG. 4, of the device for managing air flow in an air handling system showing the linkage assembly in the extended (first) position.
Figure 6:
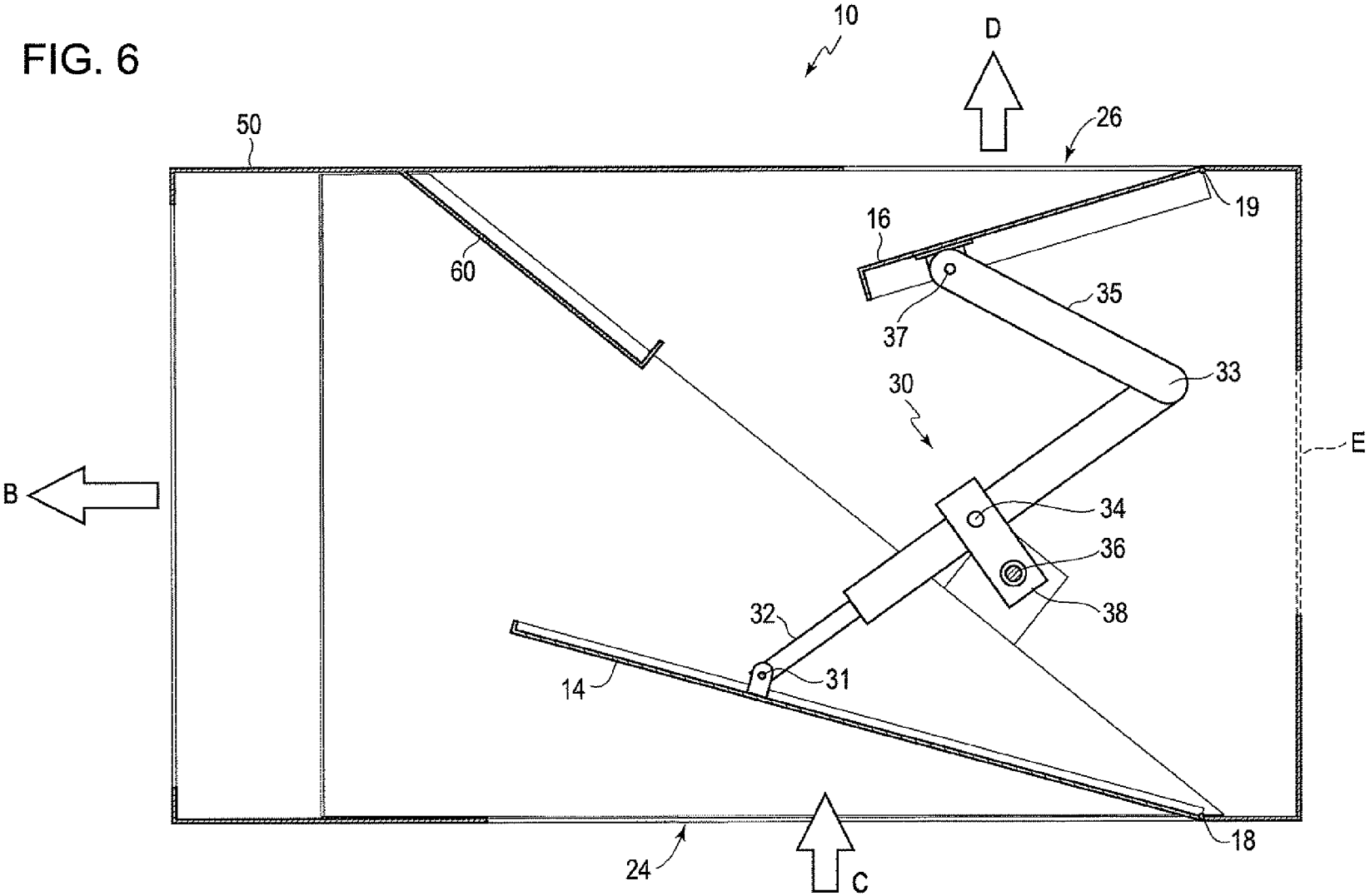
FIG. 6 illustrates a second exemplary cross-sectional view, taken along the line A-A in FIG. 4, of the device for managing air flow in an air handling system showing the linkage assembly in transit from the extended (first) position to the retracted (second) position.
Figure 7:
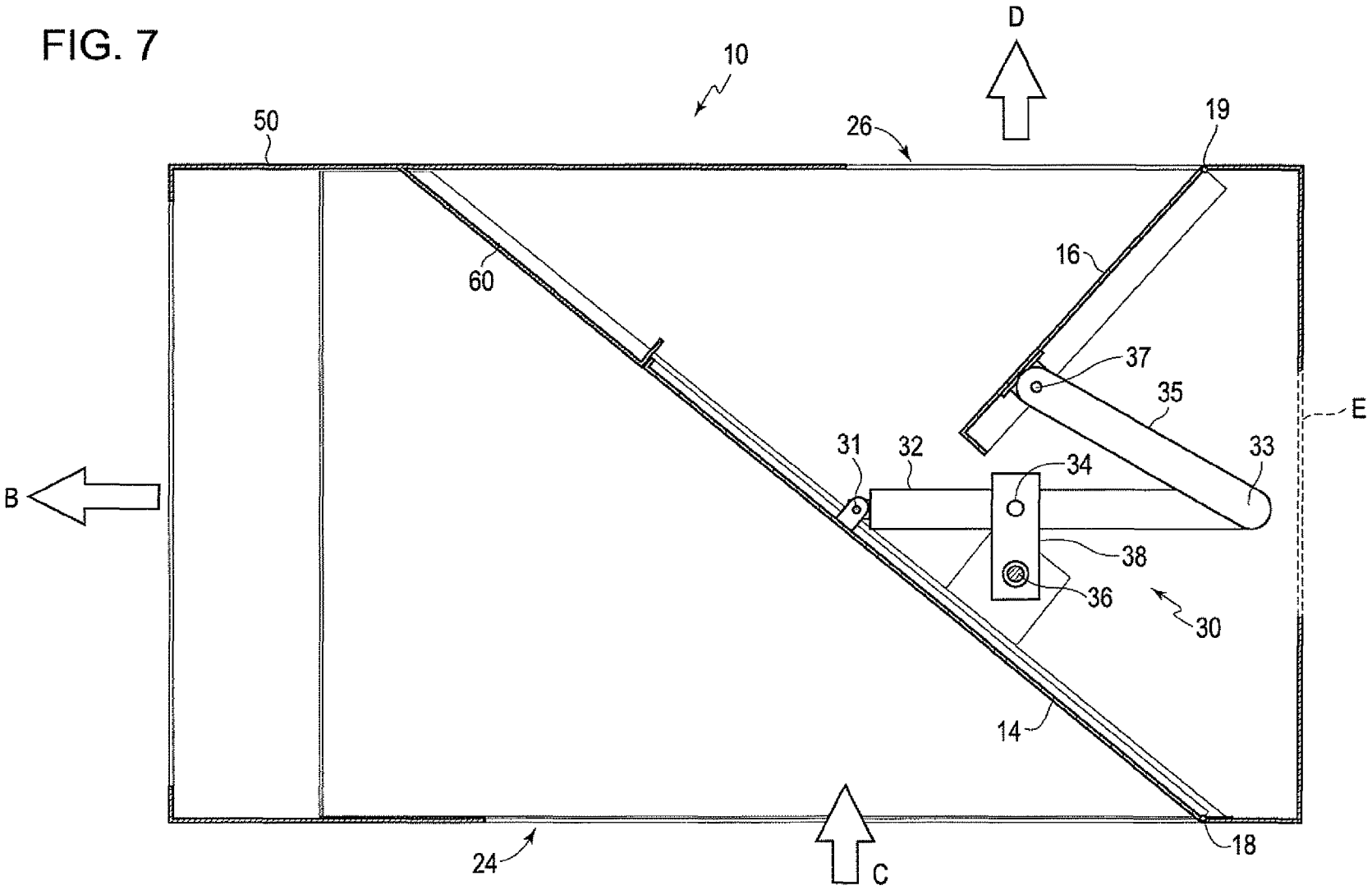
FIG. 7 illustrates an exemplary cross-sectional view, taken along the line A-A in FIG. 4, of the device for managing air flow in an air handling system showing the linkage assembly in the retracted (second) position.
Figure 8:
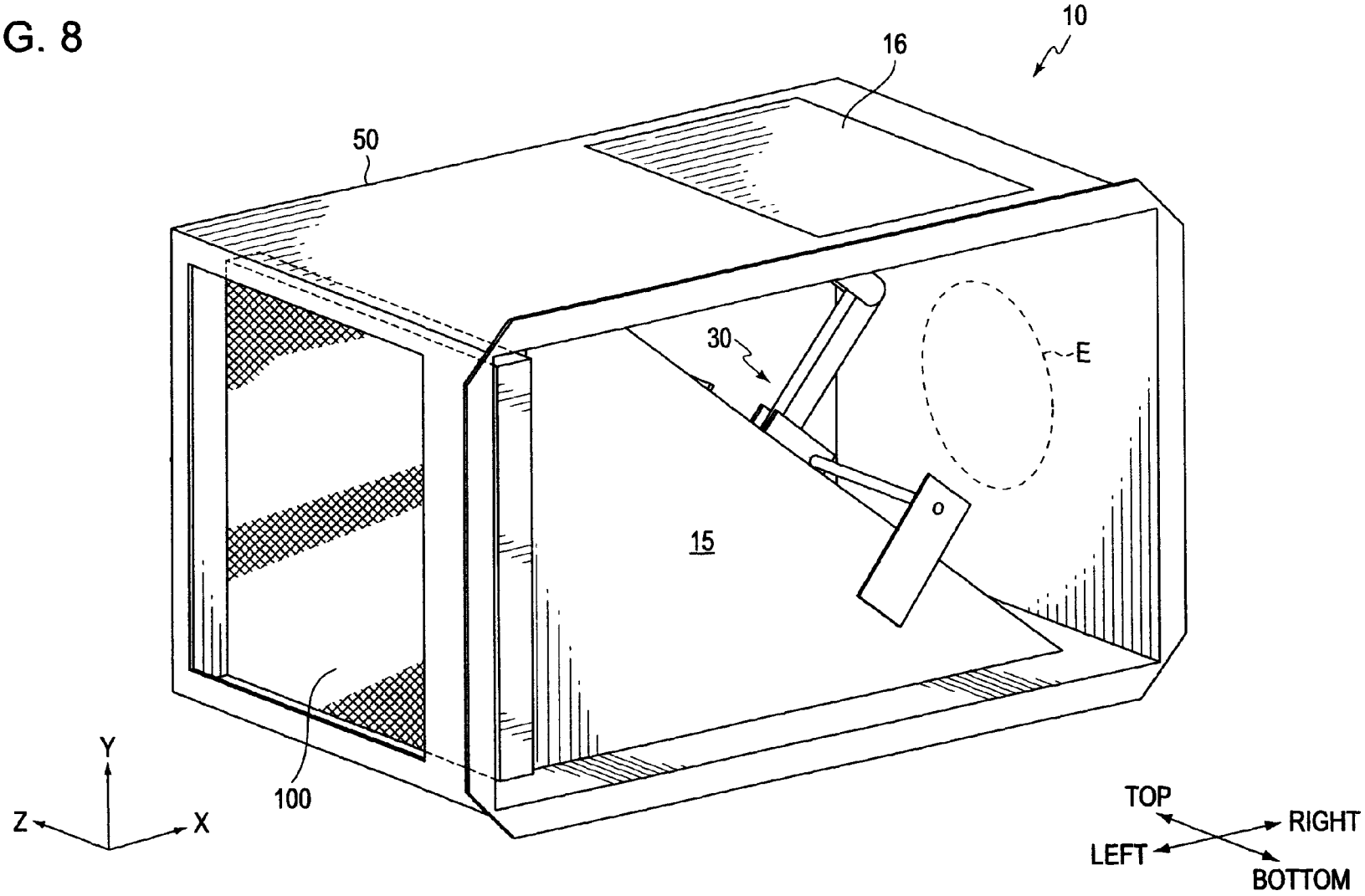
FIG. 8 illustrates an exemplary perspective view of the device for managing air flow in an air handling system showing a filter.

FIGS. 5-7 are provided in a perspective view along section line A-A shown in FIG. 4 to aid in understanding of the systems and methods according to this disclosure. Additional detail is provided regarding the elements of the linkage assembly 30. A holding assembly 31 attaches the single actuator 32 to air deflector 14. At an opposite end from the holding assembly 31, the actuator 32 is connected to a follower arm 35 at an elbow 33. Follower arm 35 is then connected to second air deflector 16 via a second connecting device 37. In this regard, the linking assembly 30 positively and cooperatively links the first air deflector 14 to the second air deflector 16 in order that the retracting movement of each of the air deflectors is cooperatively coordinated and positively controlled via the single actuator 32.

The systems and methods according to this disclosure advantageously make use of this cooperation to provide coordinated movement of the first air deflector 14 and the second air deflector 16 between their closed positions shown in FIG. 5, in which they seal openings in the outside of the outer cabinet 50, or otherwise in the duct work in which they are placed. The movement of the actuator to a retracted position causes the first air deflector 14 and the second air deflector 16 to cooperatively rotate inward into an inner space of the outer cabinet 50, or otherwise the duct work in which the air handling device is installed in order that movement of the first air deflector 14 and the second air deflector 16 is not impeded by any, for example, obstructions external to the outer cabinet 50, or duct work in which the air handling device is placed.

FIG. 5 illustrates a cross-sectional view of the air handling device 10 in the extended position. The linkage assembly 30 is fully extended through full extension of the actuator 32, applying pressure to seal each of the first movable air deflector 14 and the second movable air deflector 16 to the openings in the outer cabinet 50. This sealing pressure prevents leakage of recirculated air flowing in a direction into the figure via the upper right hand corner of the figure around the partition 15 (not shown) and then flowing left in the direction B out of the exhaust of the outer cabinet 50 of the air handling device 10. This is the recirculating air mode, which circulates air from the enclosed space that is supported by the air handling system through the air handling system and back to the enclosed space. The positively controlled sealing of the first air deflector 14 and the second air deflector 16 against outer openings in the outer cabinet 50 prevents leakage or other back pressure within the air handling system in which the air handling device 10 is placed.

FIG. 6 illustrates a cross-sectional view of the air handling device 10 in transit from the extended position to the retracted position. The actuator 32 of the linkage assembly 30 begins to retract and rotate along the pivot point 34 of the linkage bracket 38. The actuator pulls the first movable air deflector 14 away from opening 24 in a wall of the outer cabinet 50 to begin to admit outside air flow C into the air handling device 10 via opening 24. As the actuator is cooperatively rotated about the shaft 36 due to the configuration of the linkage assembly 30, follower arm 35 is pulled back into the right in this depiction causing the second movable air deflector 16 to be pulled away from opening 26 in an opposite wall of the outer cabinet 50 providing an exhaust port by which exhaust air D can exit the enclosed space via the air handling system based on over pressure within the enclosed space. The motion of the linkage assembly 30 advantageously allows the first movable air deflector 14 and the second movable air deflector 16 to simultaneously rotate open inwardly along the door hinges 18, 19.

FIG. 7 illustrates the air handling device 10 in the retracted position. The actuator 32 of the linkage assembly 30 is fully retracted. The actuator 32 rotates along the pivot point 34 of the linkage bracket 38. This motion allows the first movable air deflector 14 and the second movable air deflector 16 to rotate fully open along the door hinges 18, 19. The first movable air deflector 14 mates with an inner wall 60 of the air handling device 10 in the outer cabinet 50 to provide an airtight sealing surface. This sealing surface separates the intake air flow path from the exhaust air flow path and minimizes air from leaking across the boundary. Thus, system efficiency is maximized.

It should be appreciated that various of the above disclosed and other features and functions, or alternatives thereof, may be desirably combined into many of other different devices. Also, various presently and unforeseen or unanticipated alternatives, modifications, variations or improvements therein may be subsequently made by those skilled in the art which are also intended to be encompassed by this disclosure.

What is claimed is:

1. A device for managing airflow in an air handling system, comprising:

a first movable air deflector that is movable between a first position and a second position;

a second movable air deflector that is a separate air deflector from the first movable air deflector and that is movable between a first position and a second position; and a linkage assembly connecting the first movable air deflector and the second movable air deflector, the linkage assembly including a single actuator and being configured to:

(1) cooperatively move the first movable air deflector and the second movable air deflector between the respective first position and the second position by a linear extension or a linear retraction of the single actuator, and (2) apply sealing pressure to each of the first movable air deflector and the second movable air deflector to establish a substantially airtight seal around the each of the first movable air deflector and the second movable air deflector in the first position, and around the first movable air deflector in the second position.

2. The device for managing airflow in an air handling system according to claim 1, wherein the respective first position of the each of the first movable air deflector and the second movable air deflector positively seals a respective first opening in a first outside wall of the air handling system and a respective second opening that is separate from the first opening in a second outside wall of the air handling system to provide a recirculating air flow path for recirculating air from an enclosed space through the air handling system.

3. The device for managing airflow in an air handling system according to claim 1, wherein the respective second position of the each of the first movable air deflector and the second movable air deflector opens a respective first opening in a first outside wall of the air handling system and a respective second opening that is separate from the first opening in a second outside wall of the air handling system, by moving each of the first movable air deflector and the second movable air deflector inward away from the respective first position sealing the first opening and the second opening.

4. The device for managing airflow in an air handling system according to claim 2, wherein the respective second position of the each of the first movable air deflector and the second movable air deflector opens the respective first opening in the first outside wall of the air handling system and the respective second opening that is separate from the first opening in the second outside wall of the air handling system, to provide (1) an intake air flow path to admit outside air into the air handling system via the first opening, and (2) an exhaust air flow path to exhaust air from the enclosed space to outside the air handling system, and the second position of the first movable air deflector provides a substantially airtight seal against the opening in a partition, segregating the intake air flow path from the exhaust air flow path.

5. The device for managing airflow in an air handling system according to claim 4, further comprising:

a third opening in a third outside wall that provides a first return air inlet source from the enclosed space; and a fourth opening in a fourth outside wall that provides a fan inlet air source, wherein the respective first position of the each of the first movable air deflector and the second movable air deflector provides a recirculating air flow path for recirculation of air from the enclosed space between the third opening and the fourth opening, and the respective second position of the each of the first movable air deflector and the second movable air deflector provides air flow from the enclosed space between the first opening and the fourth opening and between the third opening and the second opening.

6. The device for managing airflow in an air handling system according to claim 5, further comprising:

a fifth opening in a fifth outside wall that provides a second return air inlet source from the enclosed space, wherein the respective first position of the each of the first movable air deflector and the second movable air deflector provides a recirculating air flow path for recirculation of air from the enclosed space between the fifth opening and the fourth opening, and the respective second position of the each of the first movable air deflector and the second movable air deflector provides air flow from the enclosed space between the fifth opening and the second opening.

7. The device for managing airflow in an air handling system according to claim 1, the linkage assembly further comprising:

a shaft; and a linkage bracket rotatably attached to the shaft and fixed to the single actuator at a pivot point, wherein the single actuator is connected to the first movable air deflector via a first connecting assembly and is connected to the second movable air deflector via a second connecting assembly.

8. The device for managing airflow in an air handling system according to claim 1, further comprising an accommodating portion that accommodates at least one filter.

9. A system for managing airflow in an air handling system, comprising a first air deflecting means movable between a first position and a second position;

a second air deflecting means that is separate from the first air deflecting means and movable between a first position and a second position; and a means for moving the first air deflecting means and the second air deflecting means, the moving means including a single actuator and being configured to:

(1) cooperatively move the first air deflecting means and the second air deflecting means between the respective first position and second position by a linear extension or a linear retraction of the single actuator, and (2) apply sealing pressure to each of the first air deflecting means and the second air deflecting means to establish a substantially airtight seal around the each of the first air deflecting means and the second air deflecting means in the first position, and around the first air deflecting means in the second position.

10. The system for managing air flow in an air handling system according to claim 9, wherein the moving means moves the each of the first air deflecting means and the second air deflecting means to the respective first position to positively seal a respective first opening in a first outside wall of the air handling system and a respective second opening that is separate from the first opening in a second outside wall of the air handling system to provide a recirculating air flow path for recirculating air from an enclosed space through the air handling system.

11. The system for managing air flow in an air handling system according to claim 9, wherein the moving means moves the each of the first air deflecting means and the second air deflecting means to the respective second position to open a respective first opening in a first outside wall of the air handling system and a respective second opening that is separate from the first opening in a second outside wall of the air handling system, by moving each of the first air deflecting means and the second air deflecting means inward away from the respective first position sealing the first opening and the second opening.

12. The system for managing air flow in an air handling system according to claim 10, wherein the moving means moves the each of the first air deflecting means and the second air deflecting means to the respective second position to open the respective first opening in the first outside wall of the air handling system and the respective second opening that is separate from the first opening in the second outside wall of the air handling system, to provide (1) an intake air flow path to admit outside air into the air handling system via the first opening, and (2) an exhaust air flow path to exhaust air from the enclosed space to outside the air handling system, and the moving means moves the first air deflecting means to the second position to provide a substantially airtight seal against the opening in a partition, segregating the intake air flow path from the exhaust air flow path.

13. A method for managing airflow in an air handling system, comprising:

positioning a first movable air deflector in one of a first position and a second position; and positioning a second movable air deflector that is a separate air deflector from the first movable air deflector in a corresponding one of a first position and a second position, the position of the first movable air deflector and the second movable air deflector being adjusted via a linkage assembly, the linkage assembly including a single actuator and being configured to:

(1) move the first movable air deflector and the second movable air deflector cooperatively between the respective first position and the second position by a linear extension or a linear retraction of the single actuator, and (2) apply sealing pressure to each of the first movable air deflector and the second movable air deflector to establish a substantially airtight seal around the each of the first movable air deflector and the second movable air deflector in either of the respective first position and the second position for the first movable air deflector and in the first position for the second movable air deflector.

14. The method for managing air flow in an air handling system according to claim 13, wherein moving the location of the each of the first movable air deflector and the second movable air deflector to the respective first position to positively seal a respective first opening in a first outside wall of the air handling system and a respective second opening that is separate from the first opening in a second outside wall of the air handling system to provide a recirculating air flow path for recirculating air from an enclosed space through the air handling system.

15. The method for managing air flow in an air handling system according to claim 13, wherein moving the location of the each of the first movable air deflector and the second movable air deflector to the respective second position to open a respective first opening in a first outside wall of the air handling system and a respective second opening that is separate from the first opening in a second outside wall of the air handling system, by moving each of the first movable air deflector and the second movable air deflector inward away from the respective first position sealing the first opening and the second opening.

16. The method for managing air flow in an air handling system according to claim 14, wherein moving the location of the each of the first movable air deflector and the second movable air deflector to the respective second position to open the respective first opening in the first outside wall of the air handling system and the respective second opening that is separate from the first opening in the second outside wall of the air handling system, to provide (1) an intake air flow path to admit outside air into the air handling system via the first opening, and (2) an exhaust air flow path to exhaust air from the enclosed space to outside the air handling system, and moving the location of the first movable air deflector to the second position to provide a substantially airtight seal segregating the intake air flow path from the exhaust air flow path.

17. The device for managing airflow in an air handling system according to claim 1, wherein:

the linkage assembly includes a follower arm linked to the single actuator by an elbow joint, and the follower arm is configured to rotate about the elbow joint in response to an extension or retraction of the single actuator such that the second moveable air deflector is displaced between the respective first position and second position.

18. The system for managing air flow in an air handling system according to claim 9, wherein:

the linkage assembly includes a follower arm linked to the single actuator by an elbow joint, and the follower arm is configured to rotate around the elbow joint in response to an extension or retraction of the single actuator such that the second moveable air deflector is displaced between the respective first position and second position.

19. The method for managing air flow in an air handling system according to claim 13, wherein:

the linkage assembly includes a follower arm linked to the single actuator by an elbow joint, and the follower arm is configured to rotate around the elbow joint in response to an extension or retraction of the single actuator such that the second moveable air deflector is displaced between the respective first position and second position.

20. The device for managing airflow in an air handling system according to claim 17, wherein:

the elbow joint is formed by a connection between the end of the follower arm and an end of the single actuator, and another end of the follower arm is connected to the second movable air deflector.

* * * * *